US008149204B2

(12) United States Patent
Lim

(10) Patent No.: US 8,149,204 B2
(45) Date of Patent: Apr. 3, 2012

(54) GATE DRIVER WITH ERROR BLOCKING MECHANISM, METHOD OF OPERATING THE SAME, AND DISPLAY DEVICE HAVING THE SAME

(75) Inventor: Myong-Bin Lim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 697 days.

(21) Appl. No.: 12/333,924

(22) Filed: Dec. 12, 2008

(65) Prior Publication Data

US 2009/0174646 A1 Jul. 9, 2009

(30) Foreign Application Priority Data

Jan. 7, 2008 (KR) ..... 10-2008-0001545

(51) Int. Cl.
*G09G 3/36* (2006.01)

(52) U.S. Cl. ..... 345/100; 345/98

(58) Field of Classification Search ..... None
See application file for complete search history.

(56) References Cited

U.S. PATENT DOCUMENTS 6,667,730 B1 * 12/2003 Taguchi et al. ..... 345/99

* cited by examiner

*Primary Examiner* — Muhammad N Edun
(74) *Attorney, Agent, or Firm* — Innovation Counsel LLP

(57) ABSTRACT

A liquid crystal display (LCD) includes a plurality of gate line drivers that are to be sequentially activated during a display frame in response to an input vertical synchronization start signal having a predefined waveform. However, during shift of display mode it is possible that the vertical synchronization start signal will be asserted more then once in a frame and cause a problem. The LCD includes an error detecting and blocking unit which detects when the vertical synchronization start signal is asserted more then once in a frame and blocks the second assertion from being passed forward during the one frame so as to erroneously reactivate the plurality of gate line drivers a second time during the same frame.

20 Claims, 5 Drawing Sheets

GATE DRIVER WITH ERROR BLOCKING MECHANISM, METHOD OF OPERATING THE SAME, AND DISPLAY DEVICE HAVING THE SAME

CROSS-REFERENCE TO RELATED APPLICATION

This application claims priority from Korean Patent Application No. 10-2008-0001545 filed on Jan. 7, 2008, in the Korean Intellectual Property Office, the disclosure of which is incorporated herein by reference in its entirety.

BACKGROUND

1. Field of Invention

The present disclosure of invention relates to a gate driver, a method of driving the same, and a display device having the same. More particularly, the present invention relates to a gate driver, a method of driving the same, and a display device having the same that are capable of detecting occurrence of an error in a vertical synchronization start signal input from a timing controller.

2. Description of Related Technology

In general, a liquid crystal display (LCD) device includes a liquid crystal display panel, a gate driving unit, a data driving unit, a driving voltage generator, and a timing controller. The liquid crystal display panel includes a thin-film transistor substrate that has pixel electrodes formed thereon, a color filter substrate that has a common electrode formed thereon, and a liquid crystal layer that is interposed between the thin-film transistor substrate and the color filter substrate. The gate driving unit and the data driving unit apply signals to perform display operations on the liquid crystal display panel, and the driving voltage generator generates various driving voltages to drive the liquid crystal display device. The timing controller generates pixel data and control signals used to drive the gate driving unit, the data driving unit, and the driving voltage generator.

The gate driving unit connects to a plurality of gate lines on the thin-film transistor substrate and it correspondingly includes a plurality of gate drivers each of which includes a shift register unit, a level shifter unit, and an output buffer unit for driving its respective gate line. The shift register unit performs a shift operation in response to a vertical synchronization start signal and a gate clock signal input from the timing controller. In response to a generated shift signal, the level shifter shifts a level of the shift signal to a level of a gate turn-on voltage ($V_{Gon}$) or a gate turn-off voltage ($V_{Goff}$). The output buffer unit then transmits the gate turn-on voltage or the gate turn-off voltage to a corresponding one of the gate lines. Here, the gate turn-on voltage and the gate turn-off voltage are generated by the driving voltage generator.

The timing controller uses a data enable signal input from a system to generate the vertical synchronization start signal and a gate clock signal to drive the gate driver. However, in a conventional system, even when an error occurs in the data enable signal provided from the host system, the timing controller uses the data enable signal as it is to generate the vertical synchronization start signal. As a result, an error also occurs in the vertical synchronization start signal.

In general, only one vertical synchronization start signal should be generated for each frame. However, the data enable signal may be irregularly supplied to the timing controller from a host system, for example such as at a time of a screen mode conversion in a TV image in response to an external input commanding such a mode change. In this case, the timing controller can undesirably output a plurality of vertical synchronization start signals before one corresponding frame ends. If the plurality of vertical synchronization start signals are simultaneously responded to during one frame, the conventional gate driver simultaneously outputs the gate turn-on voltage to a plurality of gate lines. In this case, the gate turn-on voltage that is generated by the driving voltage generator needs to be simultaneously supplied to a load comprised of a plurality of level shifters. In one class of embodiments, the magnitude of current of the driving voltage generator, which is needed to supply a desired voltage to one level shifter, is approximately several tens of milliamperes, but if the voltage is simultaneously supplied to the plurality of level shifters, overload is generated in the driving voltage generator, which causes the driving voltage generator to shut down as a safety precaution. That is, if the plurality of level shifters simultaneously operate, a large amount of current flows through the driving voltage generator that supplies a high voltage to the level shifters, which causes the driving voltage generator to shut down and then the whole screen may fail to operate properly during the frame.

SUMMARY

In accordance with the disclosure, an error detecting unit is provided to detect if a vertical synchronization start signal is asserted (e.g., as active high) by more than the predetermined number of gate clock signal pulses during one frame.

According to one embodiment, a gate driver includes an error detecting unit that measures the number of gate clock signals in an interval where an input vertical synchronization start signal is at a high level during one frame, and outputs gated version of the vertical synchronization start signal or a low-level signal. The gate driver further includes a shift register unit that receives an output signal of the error detecting unit and outputs one or more shifted signals, a level shifter unit that shifts a level of at least one of the level-shifted shift signals and outputs the one or more shifted signals, and an output buffer unit that supplies an output signal of the level shifter unit to a corresponding gate line.

The error detecting unit may output the vertical synchronization start signal when the measured number of gate clock signals is smaller than a predetermined value (e.g., 4), and the low-level signal after the measured number is determined to be equal to or larger than the predetermined value.

The shift register unit may shift a level of the output signal of the error detecting unit in response to the gate clock signal.

The error detecting unit may include a plurality of flip-flops that shift forward by one step an assertion level of an input vertical synchronization start signal each time the vertical synchronization start signal is asserted for one period of the corresponding gate clock signal. If the number of shifts during one frame exceeds a predetermined maximum, it is then known that the input vertical synchronization start signal has been asserted during the one frame for more clock periods than allowed.

In one embodiment, the plurality of flip-flops operate in response to at least two signals associated with the vertical synchronization start signal, namely, the gate clock signal, and a carry signal. A first of the flip-flops may latch onto as its input data, the vertical synchronization start signal in response to the carry signal (C) and a first edge of the input vertical synchronization start signal. A second flip-flop may latch onto as its input data, a logical combination of signals output from the first flip-flop, the third and fourth flip-flops and the carry signal in response to the carry signal (C) and the first edge of the input vertical synchronization start signal. A third flip-flop may latch onto as its input data, a logical combination of signals output from the second flip-flop, the fourth flip-flop and the carry signal in response to the carry signal (C) and the first edge of the input vertical synchronization start signal.

The carry signal may be output from a previous gate driver and the duration of the carry signal being asserted (e.g., as logic high) may vary according to the number of data pulses latched by a shift register unit of the previous gate driver.

The error detecting unit may further include a first logical unit that receives the carry signal and the gate clock signal, a second logical unit that receives the gate clock signal and the vertical synchronization start signal, and a third logical unit that receives output signals of the first and second logical units. The plurality of flip-flops may be driven according to an output signal of the third logical unit.

The error detecting unit may further include a fourth logical unit that receives the carry signal and the output signal of the next flip-flop, and a fifth logical unit that receives an output signal of the fourth logical unit and the vertical synchronization start signal. The first flip-flop may latch a level of an output signal of the fifth logical unit.

The error detecting unit may further include a sixth logical unit that receives an inversion signal of the carry signal and the output signal of the previous flip-flop, a seventh logical unit that receives the carry signal and the output signal of the next flip-flop, and an eighth logical unit that receives output signals of the sixth and seventh logical units. The final flip-flop may latch a level of an output signal of the next logical unit.

According to another aspect of the disclosure, a method of driving a gate driver includes measuring the number of gate clock signals in an interval where a vertical synchronization start signal is at a high level during one frame and outputting the vertical synchronization start signal or a low-level signal, outputting a plurality of shift signals according to the vertical synchronization start signal in response to the gate clock signal, shifting levels of the shift signals in response to the shift signals and outputting the level-shifted shift signals, and supplying the shift signals to gate lines.

According to still another aspect of the disclosure, a display device includes a display panel that displays an image, a timing controller that processes an externally input image signal and generates a plurality of control signals, a driving voltage generator that generates a plurality of driving voltages including a gate driving voltage and a data driving voltage, gate drivers each of which measures the number of gate clock signals in an interval where a vertical synchronization start signal is at a high level during one frame, selectively outputs the vertical synchronization start signal or a low-level signal, and applies the gate driving voltage to gate lines in response to the vertical synchronization start signal, and a data driver that generates a data signal using the data driving voltage and applies the data signal to data lines.

In one embodiment, each of the gate drivers may include an error detecting unit that measures the number of gate clock signals in an interval where the vertical synchronization start signal is at a high level during one frame and outputs the vertical synchronization start signal or the low-level signal, a shift register unit that receives an output signal of the error detecting unit and outputs level-shifted shift signals, a level shifter unit that shifts levels of the shift signals in response to the shift signals and outputs the shift signals, and an output buffer unit that supplies an output signal of the level shifter unit to gate lines.

The level shifter unit has a plurality of level shifters. The error detecting unit may detect the vertical synchronization start signal that is erroneously input such that it may cause an excessive number of the level shifters of the level shifter unit simultaneously operate during one frame and thus cause the driving voltage generator to abnormally operate. The error detecting unit may include a plurality of flip-flops that shift a level of the vertical synchronization start signal whenever the vertical synchronization start signal is input in synchronization with the gate clock signal.

The error detecting unit may further include an inverter that inverts an output signal of the final flip-flop, and a logical unit that receives an output signal of the inverter and the vertical synchronization start signal and outputs the received signals to the shift register unit.

The first gate driver may receive the vertical synchronization start signal from the timing controller and a next gate driver receives the vertical synchronization start signal from the previous gate driver.

BRIEF DESCRIPTION OF THE DRAWINGS

The above and other features and advantages of the present disclosure will become more apparent by describing in detail an embodiment thereof with reference to the attached drawings in which.

DETAILED DESCRIPTION

Figure 1:
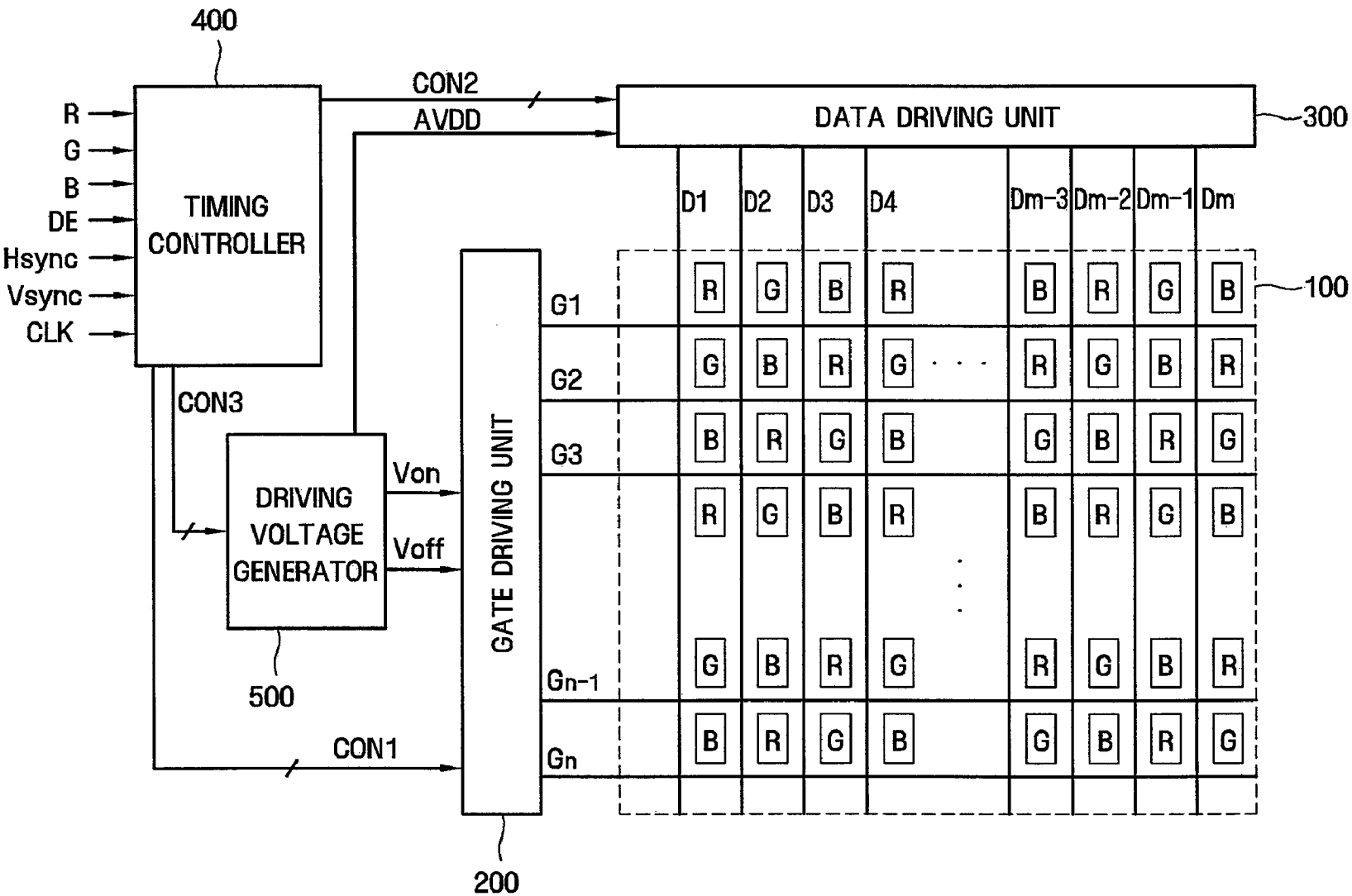
FIG. 1 is a block diagram illustrating a structure of a liquid crystal display device according to an embodiment.

Hereinafter, one or more embodiments will be described in detail with reference to the accompanying drawings. The here disclosed concept may, however, be embodied in many different forms and should not be construed as being limited to the embodiments set forth herein. Rather, these embodiments are provided such that this disclosure will be thorough and complete and will fully convey the concepts to those skilled in the art. Like reference numerals refer to like elements throughout the specification.

Figure 2:
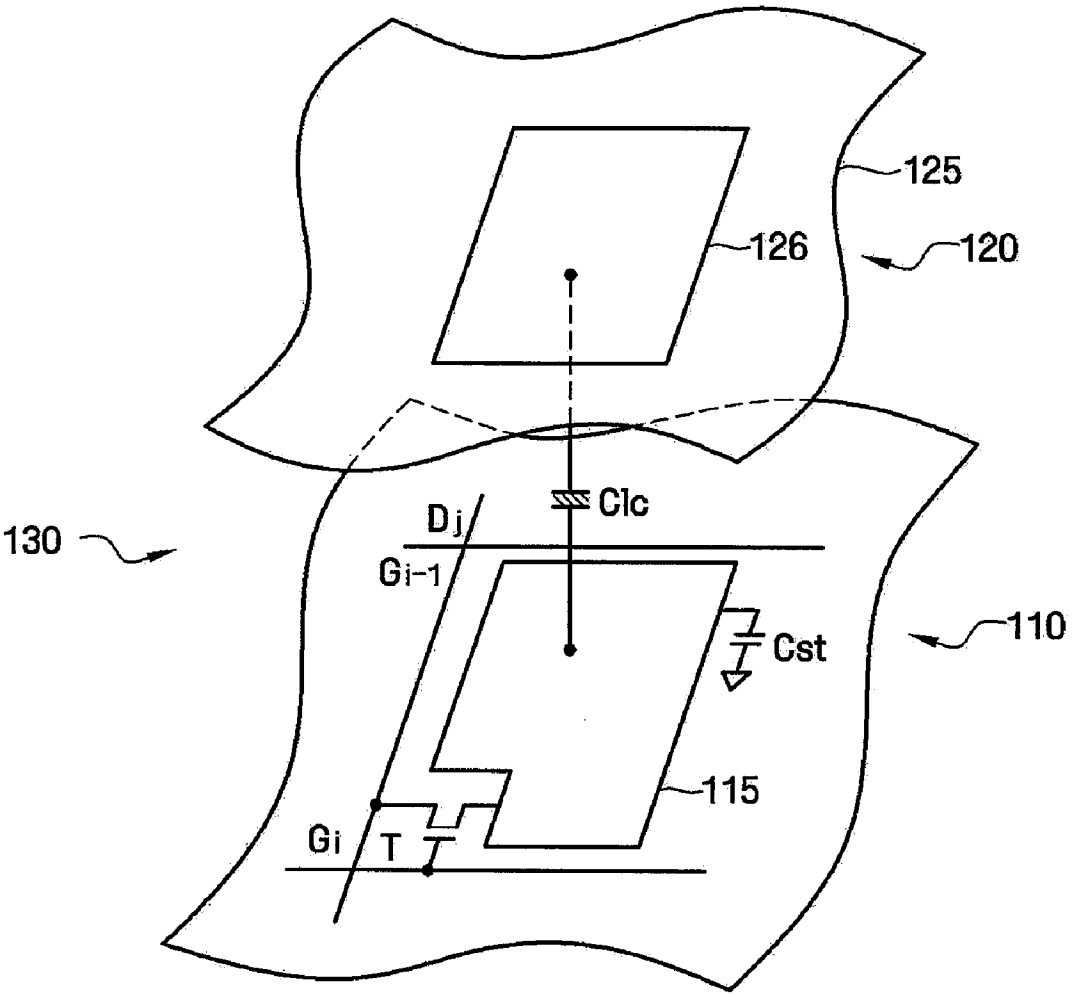
FIG. 2 is an equivalent circuit diagram illustrating one pixel of a liquid crystal display panel according to an embodiment.
Figure 3:
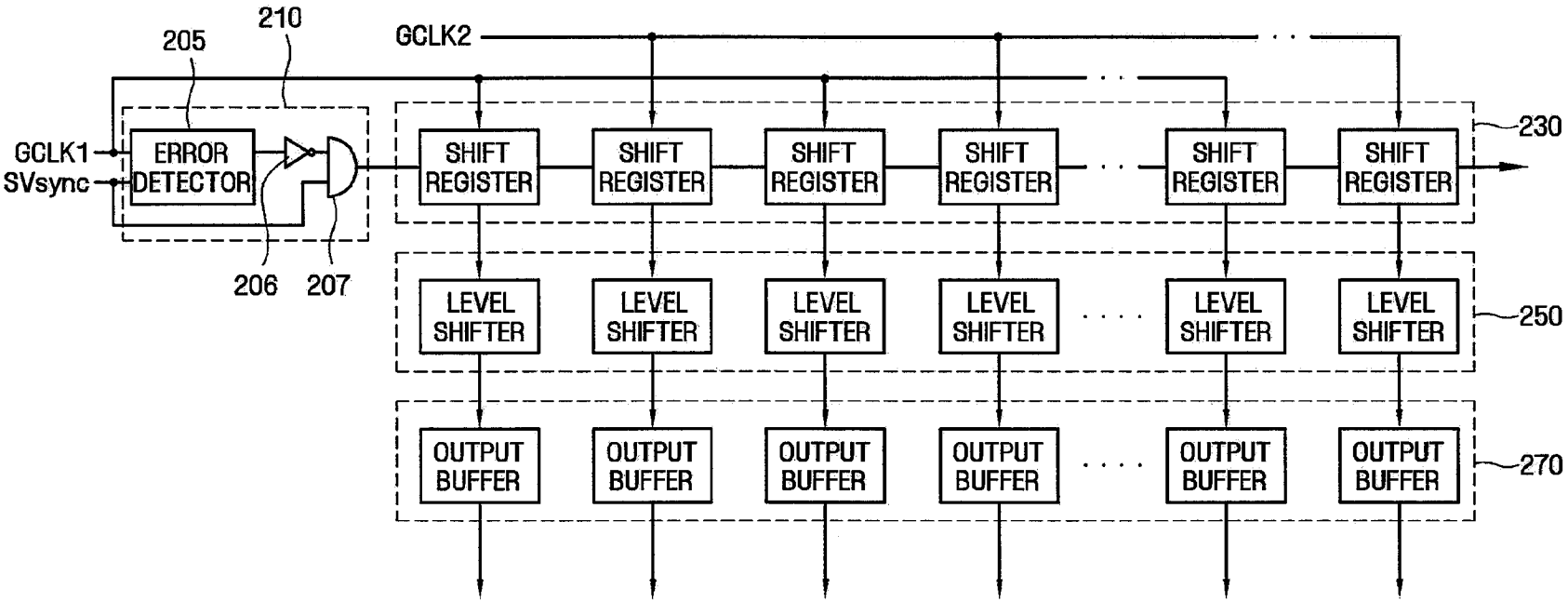
FIG. 3 is a diagram illustrating a structure of a gate driver according to an embodiment.

FIG. 1 is a block diagram illustrating a structure of a liquid crystal display device according to an embodiment. FIG. 2 is an equivalent circuit diagram illustrating one pixel of a liquid crystal display panel according to an embodiment. FIG. 3 is a diagram illustrating a structure of a gate driver according to an embodiment.

Referring to FIGS. 1 and 2, a liquid crystal display device according to an embodiment includes a liquid crystal display panel 100, a gate driving unit 200, a data driving unit 300, a timing controller 400, and a driving voltage generator 500. The liquid crystal display panel 100 includes a matrix of thin-film transistors T (one shown in FIG. 2), liquid crystal capacitors Clc, and storage capacitors Cst that are respectively connected to the plurality of gate lines G1 to Gn and a plurality of data lines D1 to Dm disposed to cross each other, and display an image frame. The gate driving unit 200 is connected to the gate lines G1 to Gn and controls the operation of the thin-film transistors T, and includes a plurality of gate drivers. The data driving unit 300 controls data signals applied to the liquid crystal capacitors Clc and the storage capacitors Cst through the thin-film transistors T and includes a plurality of data drivers. The timing controller 400 controls the gate driving unit 200 and the data driving unit 300 using external control signals such as the illustrated R, G, B, DE, Hsync, Vsync, and CLK. The driving voltage generator 500 generates gate driving voltages Von and Voff of the gate driving unit 200 and a driving voltage AVDD of the data driving unit 300 according to signals applied from the timing controller 400.

The liquid crystal display panel 100 includes the plurality of gate lines G1 to Gn that extend in one direction, the plurality of data lines D1 to Dm that extend in a direction orthogonal to the plurality of gate lines G1 to Gn, and pixel regions that are formed to correspond to intersections between the gate lines G1 to Gn and the data lines D1 to Dm. In the pixel regions, pixels each including a thin-film transistor T, a storage capacitor Cst, and a liquid crystal capacitor Clc are respectively provided. The pixels include red (R) pixels, green (G) pixels, and blue (B) pixels. For example, the red (R), green (G), and blue (B) pixels are sequentially disposed in odd-numbered row directions, and the blue (B), red (R), and green (G) pixels are sequentially disposed in even-numbered row directions. However, the present disclosure is not limited thereto, and the red, green, and blue pixels may be disposed in other arrangement methods. For example, the red (R), green (G), and blue (B) pixels may be disposed in such a manner that pixels having the same color are not continuously disposed in row and column directions. The liquid crystal display panel 100 includes a thin-film transistor substrate 110 where the thin-film transistors T, the gate lines G1 to Gn, the data lines D1 to Dm, and the pixel electrodes 115 are provided, a common electrode substrate 120 where a black matrix, color filters 126, and a common electrode 125 are provided, and liquid crystal 130 that is interposed between the thin-film transistor substrate 110 and the common electrode substrate 120.

In this case, each of the thin-film transistors T includes a gate terminal, a source terminal, and a drain terminal. The gate terminals are connected to the gate lines G1 to Gn, the source terminals are connected to the data lines D1 to Dm, and the drain terminals are connected to the pixel electrodes 115. The thin-film transistors T operate according to gate driving signals applied to the gate lines G1 to Gn, and supply data signals supplied through the data lines D1 to Dm to the pixel electrodes to change an electric field at both ends of the liquid crystal capacitor Clc. As a result, the arrangement of the liquid crystal 130 inside the liquid crystal display panel 100 is changed, thereby controlling transmittance of light supplied from a backlight source (not shown).

Further, a plurality of cutout and protrusion patterns may be provided in the pixel electrode 115 as a domain controlling mechanism that controls a direction in which the liquid crystal is aligned in different parts of each pixel. In addition, protrusion and cutout patterns may be provided in the common electrode 125.

The gate driving unit 200, the data driving unit 300, the timing controller 400, and the driving voltage generator 500 provide a plurality of signals to drive the liquid crystal display panel 100. Here, the gate driving unit 200 includes a plurality of gate drivers, and may be integrally formed on the liquid crystal display panel 100 at the same time as the liquid crystal display panel 100 is formed. The data driving unit 300 includes a plurality of data drivers, and may be mounted on the liquid crystal display panel 100, or mounted on a separate printed circuit board (PCB) and electrically connected to the liquid crystal display panel 100 through a flexible printed circuit board (FCB). The timing controller 400 and the driving voltage generator 500 may be mounted on the printed circuit board and electrically connected to the liquid crystal display panel 100 through a flexible printed circuit board.

The timing controller 400 is provided with image and control signals input from an external graphic controller (not shown), that is, pixel data (R, G, and B) and control signals to control display of the pixel data. For example, the timing controller 400 is provided with a horizontal synchronization signal Hsync, a vertical synchronization signal Vsync, a main clock CLK, and a data enable signal DE as the control signals to control the display of the pixel data. Further, the timing controller 400 processes the pixel data (R, G, and B) according to operation conditions of the liquid crystal display panel 100, and generates gate control signals CON1 and data control signals CON2 and transmits them to the gate driving unit 200 and the data driving unit 300, respectively. In this case, the gate control signals CON1 include a vertical synchronization start signal SVsync that instructs to start output of the gate turn-on voltage Von, a gate clock signal GCLK that controls an output point of time of the gate turn-on voltage Von, and an output enable signal OE that controls a duration time of the gate turn-on voltage Von. The data control signals CON2 include a horizontal synchronization start signal that informs a transmission start of the pixel data, a load signal that instructs to apply a data voltage to a corresponding data line, an inversion signal that inverts a polarity of a gray-scale voltage with respect to a common voltage, and a data clock signal. In one embodiment, the vertical synchronization start signal SVsync that instructs to start output of the gate turn-on voltage Von, has a predefined waveform such as the one shown in the right half of FIG. 5 and encoded as 101011 in binary with the logic "1" pulses consuming a total time equal to four pulses of the local gate clock (GCLK1 in the case of FIG. 5).

The driving voltage generator 500 generates various driving voltages needed to drive the liquid crystal display device using an external voltage supplied from an external power supply device according to control signals CON3 from the timing controller 400. The driving voltage generator 500 generates a reference voltage AVDD, the gate turn-on voltage Von, the gate turn-off voltage Voff, and a common voltage. The driving voltage generator 500 applies the gate turn-on voltage Von and the gate turn-off voltage Voff to the gate driving unit 200 according to the control signals CON3 from the timing controller 400 and applies the reference voltage AVDD to the data driving unit 300. In this case, the reference voltage AVDD is used to generate a gray-scale voltage driving liquid crystal.

The gate driving unit 200 begins to sequentially apply the gate turn-on/off voltages Von and Voff of the driving voltage generator 500 to the gate lines G1 through Gn in response to the vertical synchronization start signal SVsync, the gate clock signal GCLK (composed of out-of-phase complements, GCLK1 and GCLK2), and the output enable signal OE from the timing controller 500. As a result, the corresponding thin-film transistors, T of sequential horizontal display lines can be controlled such that a corresponding gray-scale voltage to be applied to each pixel of a given image row is applied to the corresponding pixel during the frame. The gate driving unit 200 includes a plurality of gate drivers for driving respective display gate lines. Each of the gate drivers includes a shift register unit 230, a respective error detecting/preventing unit 210 preceding the respective shift register unit (only one unit 210 is shown in FIG. 3 but is to be understood as repeating for each of units 230), a level shifter unit 250, and an output buffer unit 270, as shown in FIG. 3. Each error detecting/preventing unit 210 (only one shown) includes an error detector 205, an inverter 206, and an AND gate 207. Meanwhile, the shift register unit 230 and its preceding error detecting/preventing unit 210, the level shifter unit 250, and the output buffer unit 270 is part of a repeated plurality of shift registers and error detecting/preventing units, a plurality of level shifters, and a plurality of output buffers, respectively. Further, a gate turn-on voltage (Von) or turn-off voltage (Voff) is output to each gate line through its respective one shift register, one level shifter, and one output buffer. The first shift register of the shift register unit 230 is supplied with a first gate clock signal GCLK1 and the vertical synchronization start signal SVsync, and each odd numbered one of the second to final shift registers is supplied with an output signal of a previous shift register and the first gate clock signal GCLK1 while each even numbered one of the second to final shift registers is supplied with an output signal of a previous shift register and the second gate clock signal GCLK2, where the latter is out of phase with the first gate clock signal GCLK1. The shift register unit 230 of each of the second to final gate drivers is supplied with a rippled through version the vertical synchronization start signal SVsync whose level is shifted in from a previous gate driver and from the respective error detecting/preventing unit 210 (only one unit 210 is shown in FIG. 3 preceding the leftmost shift register unit 230). The output enable signal OE is input to level shifter units 250 of all the gate drivers.

Referring to FIG. 3, the error detecting unit 210 detects an error in its respectively shifted in version of the vertical synchronization start signal SVsync. Specifically, the error detecting unit 210 measures (e.g., counts) the number of gate clock signals (GCLK1 or GLCK2) in an interval where the vertical synchronization start signal SVsync is at a logic high level ("1") during one frame, and outputs either a copy of the vertical synchronization start signal SVsync to the next stage if the per frame count is acceptable or a logic low-level signal ("0") if the per frame count exceeds a predetermined acceptable count. That is, the error detector 205 detects whether the vertical synchronization start signal SVsync input in synchronization with the local gate clock signal GCLK is at logic high (active) by more than the predetermined number of times expected during one frame or not. For example, in one embodiment, the error detector 205 preceding each odd numbered shift register unit 230 detects whether the vertical synchronization start signal SVsync that is input in synchronization with the first gate clock signal GCLK1 is high for the expected four clocks of GCLK1 (see FIG. 5) or for more than the expected number of GCLK1 pulses during one frame. This determination is used by the error detector 205 to prevent an erroneous second invocation of the vertical synchronization start signal SVsync during a same frame from being passed through to the respective shift register unit 230 in order to thereby assure that the driving voltage generator 500 will not be shut down due to undesirable actuation of more than one of the level shifter units 250 at a time during a single frame. An output signal of the error detector 205 is inverted by the inverter 206, and the AND gate 207 receives an output signal of the inverter 206 and the vertical synchronization start signal SVsync and performs a logical operation on the received signals to output an operation result. Accordingly, the AND gate 207 outputs (passes along to the next stage) the vertical synchronization start signal SVsync to its respective unit 230 when an output signal of the error detector 205 is maintained at a low level (no error detected), and outputs a low-level signal when the output signal thereof is maintained at a high level (meaning an error was detected). The shift register unit 230 receives the output signal of the AND gate 207 of the preceding error detecting/preventing unit 210 and the appropriate gate clock signal GCLK (GCLK1 or GCLK2). The shift register unit 230 shifts into itself the passed through vertical synchronization start signal SVsync as output from the AND gate 207 when the output of inverter 206 is at a high level. The vertical synchronization start signal SVsync is shifted in synchronism with the local gate clock signal GLCK. That is, if the SVsync signal is let through on a stage by stage basis, the plurality of shift register units 230 transmit the passed through vertical synchronization start signal SVsync from the first shift register through to the final shift register in synchronism with respective pulses of the local gate clock signal GCLK. For the illustrated embodiment, and in regards of the gate clock signal GCLK, first and second local gate clock signals GCLK1 and GCLK2 are alternately input to successive stages, where the first gate clock signal GCLK1 is input to the odd-numbered shift registers and the second gate clock signal GCLK2 is input to the even-numbered shift registers. Whenever the vertical synchronization start signal SVsync is transmitted to the next shift register, a shift enable signal is generated from the corresponding shift register and supplied to the level shifter unit 250. The level shifter unit 250 is enabled in response to the global output enable signal OE supplied from the timing controller 400 and the local shift enable signal generated from the corresponding shift register. In response to these shift enable signals, the level shifter unit 250 shifts a level of the gate turn-on or turn-off level output by the corresponding shift register 230 and outputs the level shifted signal to the respective output buffer 270. That is, the level shifter unit 250 outputs the gate turn-on voltage Von or the gate turn-off voltage Voff generated by the driving voltage generator 500 in response to the output by the corresponding shift register 230. In this case, in one embodiment, the gate turn-on voltage Von is maintained at about +25 V, and the gate turn-off voltage Voff is maintained at about −7 V. The output buffer unit 270 sequentially transmits the gate turn-on voltage Von or the gate turn-off voltage to the respective gate line.

The data driving unit 300 generates the gray-scale voltage using the data control signal CON2 from the timing controller 500 and the reference voltage AVDD from the driving voltage generator 500 and applies the gray-scale voltage through the data lines D1 to Dm to the pixels. That is, the data driving unit 300 converts input pixel data in a digital form on the basis of the reference voltage AVDD and generates a data signal in an analog form, that is, a gray-scale voltage.

Figure 4:
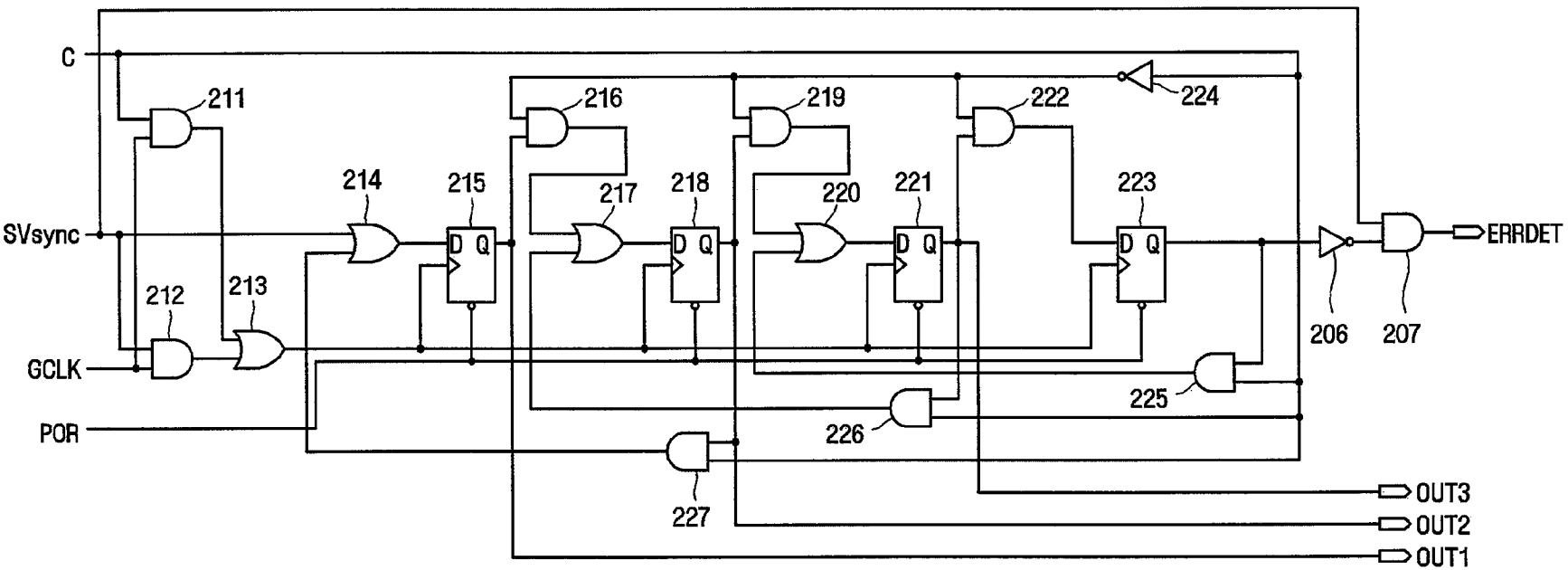
FIG. 4 is a circuit diagram illustrating an error detecting unit of a gate driver according to an embodiment.

FIG. 4 is a circuit diagram illustrating an error detecting unit of a gate driver according to one embodiment. The structure of the error detecting unit is as follows.

Referring to FIG. 4, the error detecting unit includes a plurality of AND gates, a plurality of OR gates, a plurality of flip-flops 215, 218, 221, and 223, and two inverters 206, 224. The error detecting unit receives an input vertical synchronization start signal SVsync, a gate clock signal GCLK, a carry signal C, and a control signal POR (e.g., power on reset, but also in this case a vertical blank reset) that initiates the flip-flops when a signal is applied at a low level. In the case of the first gate driver, the carry signal C is input from the timing controller 400, and in the case of each of the second to final gate drivers, the carry signal C is input from the previous gate driver (from the preceding shift register in the chain of shift register stages).

A first AND gate 211 receives the carry signal C and the local gate clock signal GCKL and performs a logical operation on the received signals, and a second AND gate 212 receives the vertical synchronization start signal SVsync and the gate clock signal GCLK and performs a logical operation on the received signals. A first OR gate 213 receives output signals of the first and second AND gates 211 and 212 and performs a logical operation on the received signals. (In order for clocking pulses to pass through OR gate 213 and onwards to clock inputs of flip-flops 215, 218, 221, 223, the carry C should be generally low while SVsync is high.) A second OR gate 214 receives the vertical synchronization start signal SVsync and an output signal of an eighth AND gate 227 and performs a logical operation on the received signals. Flip-flops 215, 218, 221, 223 are initialized to the reset states (Q=0) in response to the control signal POR being initially pulled to a low level. After being initialized, the first flip-flop 215 can latch onto a level of an output signal of the second OR gate 214 in response to a pulse edge output from the first OR gate 213. A third AND gate 216 receives an output signal (Carry-Not) of an inverter 224 and an output signal of the first flip-flop 215 and performs a logical operation on the received signals. A third OR gate 217 receives an output signal of the third AND gate 216 and an output signal of a seventh AND gate 226 and performs a logical operation on the received signals. After being initialized, the second flip-flop 218 can latch onto a level of an output signal of the third OR gate 217 in response to a pulse edge output from first OR gate 213. A fourth AND gate 219 receives the output signal of the inverter 224 and an output signal of the second flip-flop 218 and performs a logical operation on the received signals. A fourth OR gate 220 receives an output signal of the fourth AND gate 219 and an output signal of a sixth AND gate 225 and performs a logical operation on the received signals. After being initialized, the third flip-flop 221 can latch onto a level of an output signal of the fourth OR gate 220 in response to a pulse edge output from the first OR gate 213. A fifth AND gate 222 receives the output signal of the inverter 224 and an output signal of the third flip-flop 221 and performs a logical operation on the received signals. After being initialized, the fourth flip-flop 223 can latch onto a level of an output signal of the fifth AND gate 222 in response to a pulse edge output from the first OR gate 213. Inverter 224 inverts the carry signal C to thereby output a complementary C-not signal to AND gates 216, 219 and 222. A sixth AND gate 225 receives an output signal of the fourth flip-flop 223 and the carry signal C and performs a logical operation on the received signals. A seventh AND gate 226 receives the output signal of the third flip-flop 221 and the carry signal C and performs a logical operation on the received signals. An eighth AND gate 227 receives the output signal of the second flip-flop 218 and the carry signal C and performs a logical operation on the received signals. Inverter 206 inverts the output signal of the fourth flip-flop 224. AND gate 207 receives the output signal of the inverter 206 and also the vertical synchronization start signal SVsync from the previous stage and performs a logical operation on the received signals.

In this case, when the output signal of the first flip-flop 215, that is, the first output signal OUT1 switches to output at a high level, it is determined that the vertical synchronization start signal SVsync has been input as a high level for one clock of the gate clock signal GCLK during the one given frame. When the output signal of the second flip-flop 218, that is, the second output signal OUT2 is next output at a high level, it is determined that the vertical synchronization start signal SVsync has been input as a high level for a total duration of two clocks of the gate clock signal GCLK during the one frame. Further, when the output signal of the third flip-flop 221, that is, the third output signal OUT3 is next output at a high level, it is determined that the vertical synchronization start signal SVsync has been input as a high level for a total duration of three clocks of the gate clock signal GCLK during the one frame. When the output signal of the fourth flip-flop 223, that is, an error detection signal ERR-DET switches to output at a high level, it is determined that the vertical synchronization start signal SVsync has been input as a high level for a total duration of four clocks of the gate clock signal GCLK during the one frame. In this particular embodiment, after the vertical synchronization start signal SVsync has been input as a high level for a total duration of four clocks of the local gate clock signal GCLK (e.g., GCLK1) during the one frame, the input SVsync signal should not go high again in the same one frame. Accordingly, if the input SVsync signal goes high again in the same one frame this is deemed an error and AND gate 207 blocks the going-high again SVsync signal from being passed forward to the next shift register stage. In other words, when the error detection signal output from fourth flip-flop 223 is held steady at a high level, instead of the input vertical synchronization start signal SVsync being able to pass through AND gate 207 and into the next shift register stage, a signal having a steady logic zero ("0") level is input to the SVsync receiving terminal of the next shift register unit 230. As a result, when an erroneous vertical synchronization start signal SVsync is input (e.g., one that exceeds the allowed maximum of being high for 4 pulses of the local gate clock GCLK), the gate driver is not supplied with the erroneous SVsync signal and the gate driver thus continues to output a gate turn-off voltage Voff for its respective gate line. Thus, for the remaining period of the current frame, the output of the gate driver is prevented from being changed from its gate turn-off voltage Voff state. The error detecting unit is initiated according to the control signal POR (for example being pulled low during a vertical blank period between frames), and if the vertical synchronization start signal SVsync is input during a next frame, the above-described operation is repeated.

Figure 5:
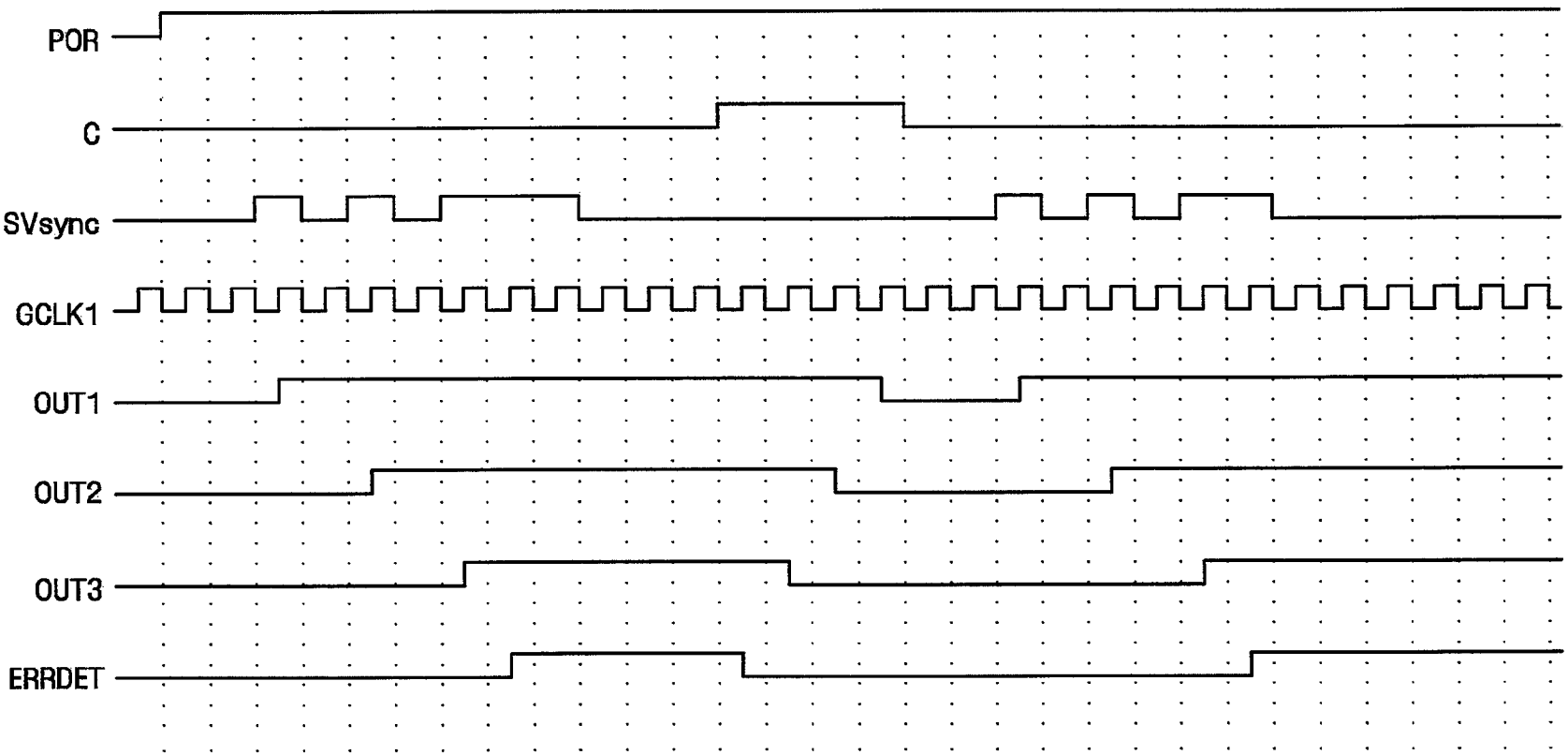
FIG. 5 is a waveform diagram illustrating the operation of an error detecting unit according to an embodiment.

A method of driving an error detecting unit according to this embodiment that has the above-described structure will be described with reference to an operation waveform shown in FIG. 5. The error detecting unit according to this embodiment detects the number of clocks of the local gate clock signal GCLK for which the vertical synchronization start signal SVsync is at a high level during the one frame, and determines whether there occurs an error in the vertical synchronization start signal SVsync due to the total number of clock pulses per frame exceeding a predetermined maximum (e.g., 4). Accordingly, the method of driving the error detecting unit in the case where the vertical synchronization start signal SVsync is applied at a high level will be described.

First, the first to fourth flip-flops 215, 218, 221, and 223 are enabled in response to the control signal POR applied at a high level after they have been initialized by POR going low (e.g., during a vertical blanking period). Then, if the vertical synchronization start signal SVsync is applied at a high level and the gate clock signal GCLK is applied at a high level, the second AND gate 212 receives the vertical synchronization start signal SVsync and the gate clock signal GCLK and performs a logical operation on the received signals to output a high-level signal. At this time, when the carry signal C is input at a low level, the first AND gate 211 receives the carry signal C and the gate clock signal GCLK and performs a logical operation on the received signals to output a low-level signal. The output signal of the first AND gate 211 at a low level and the output signal of the second AND gate 212 at a high level are input to the first OR gate 213, and the first OR gate 213 performs a logical operation on the received signals to output a high-level signal. The second OR gate 214 receives the vertical synchronization start signal SVsync and the output signal of the eighth AND gate 227. At this time, since the vertical synchronization start signal SVsync is input at a high level, the second OR gate 214 outputs a high-level signal regardless of the output signal of the eighth AND gate 227. Accordingly, the first flip-flop 215 latches a level of the second OR gate 214, that is, a high level in response to an output signal of the first OR gate 213 at a high level. Then, the first flip-flop 215 outputs a high-level signal, which is output as the first output signal OUT1.

Then, when a level of the gate clock signal GCLK is shifted to a low level, the second AND gate 212 outputs a low-level signal. Accordingly, the first OR gate 213 receives the output signal of the first AND gate 211 at a low level and the output signal of the second AND gate 212 at a low level, and outputs a low-level signal. The signal at the first flip-flop 215 is maintained at a high level in response to the output signal of the first OR gate 213 at a low level, and the signals at the second to fourth flip-flops 218, 221, and 223 are maintained at a low level. That is, even though a high-level signal is output through the third and fourth OR gates 217 and 220 and the fifth AND gate 222, the first OR gate 213 outputs a low-level signal, and thus the second to fourth flip-flops 218, 221, and 223 are maintained at a low level without inputting signals.

However, the second to fourth flip-flops 218, 221, and 223 latch a high-level signal according to the vertical synchronization start signal SVsync that is input at a high level in response to a clock cycle of the gate clock signal GCLK. This case corresponds to the case where, while the vertical synchronization start signal SVsync is maintained at a high level, the gate clock signal GCLK is maintained at a high level or after the predetermined clocks of the gate clock signal GCLK, the vertical synchronization start signal SVsync is applied at a high level and the gate clock signal GCLK is applied at a high level. This operation will be described in detail below.

If a high-level signal is latched by the first flip-flop 215 and the gate clock signal GCLK and the vertical synchronization start signal SVsync are applied at a high level, the second AND gate 212 outputs a high-level signal. Accordingly, the first OR gate 212 receives the output signals of the first and second AND gates 211 and 212 and outputs a high-level signal regardless of the output signal of the second AND gate 212. The first flip-flop 215 maintains a high level in response to the output signal of the first OR gate 213 at a high level. Further, the second flip-flop 218 latches a level of the output signal of the third OR gate 217 in response to the output signal of the first OR gate 213 at a high level. The third OR gate 217 receives the output signal of the third AND gate 216 and the output signal of the seventh AND gate 226 and performs a logical operation on the received signals. The third AND gate 216 receives the output signal of the first flip-flop 215 at a high level and the output signal of the inverter 224 at a high level and outputs a high-level signal. Therefore, the second flip-flop 218 latches a level of the output signal of the third AND gate 216, which is at a high level. The second flip-flop 218 outputs a high-level signal, which is output as a second output signal OUT2.

Further, if the a high-level signal is latched by the first and second flip-flops 215 and 218 and the gate clock signal GCLK and the vertical synchronization start signal SVsync are applied at a high level, the second AND gate 212 outputs a high-level signal. Therefore, the first OR gate 213 receives the output signals of the first and second AND gates 211 and 212 and outputs a high-level signal regardless of the output signal of the second AND gate 212. The first and second flip-flops 215 and 218 maintain a high level in response to the output signal of the first OR gate 213 at a high level. The third flip-flop 221 latches a level of the output signal of the fourth OR gate 220 in response to the output signal of the first OR gate 213 at a high level. The fourth OR gate 220 receives the output signal of the fourth AND gate 219 and the output signal of the sixth AND gate 225 and performs a logical operation on the received signals. The fourth AND gate 219 receives the output signal of the second flip-flop 218 at a high level and the output signal of the inverter 224 at a high level and outputs a high-level signal. Accordingly, the third flip-flop 221 latches a level of the output signal of the fourth AND gate 119, that is, a high level. The third flip-flop 211 outputs a high-level signal, which is output as a third output signal OUT3.

Further, if the a high-level signal is latched by the first, second, and third flip-flops 215, 218, and 221 and the gate clock signal GCLK and the vertical synchronization start signal SVsync are applied at a high level, the second AND gate 212 outputs a high-level signal. Therefore, the first OR gate 213 receives the output signals of the first and second AND gates 211 and 212 and outputs a high-level signal regardless of the output signal of the second AND gate 212. The first, second, and third flip-flops 215, 218, and 221 maintain a high level in response to the output signal of the first OR gate 213 at a high level. The fourth flip-flop 223 latches a level of the output signal of the fifth AND gate 222 in response to the output signal of the first OR gate 213 at a high level. The fifth AND gate 222 receives the output signal of the third flip-flop 221 at a high level and the output signal of the inverter 224 at a high level and outputs a high-level signal. Accordingly, the fourth flip-flop 223 latches a level of the output signal of the fifth AND gate 222, that is, a high level. The fourth flip-flop 223 outputs a high-level signal.

As described above, if the vertical synchronization start signal SVsync has been input at a high level for at least four clocks of the local gate clock signal GCLK, the first to fourth flip-flops 215, 218, 221, and 223 will have all latched to a high-level signal. If the vertical synchronization start signal SVsync has been applied as a high level for at least an accumulated four clocks of the local gate clock signal GCLK, the fourth flip-flop 223 outputs a high-level signal. In response, the input vertical synchronization start signal SVsync is prevented by AND gate 207 from being applied to the next shift register unit 230. To do so, the inverter 206 inverts the output signal of the fourth flip-flop 223, and the AND gate 207, which receives the output signal of the inverter 206 and the vertical synchronization start signal SVsync and performs a logical operation on the received signals, outputs an output signal as an error detection corrected signal (SVsync gated by ERRDETnot).

Then, if the carry signal C is applied at a high level in a state where the gate clock signal GCLK is at a high level, a level of the carry signal C is shifted to a low level through the inverter 224, and the output signal of the inverter 224 at a low level is input to one input terminal of the third, fourth, and fifth AND gates 216, 219, and 222. Accordingly, the fifth AND gate 222 receives the output signal of the inverter 224 and the output signal of the third flip-flop 221 and outputs a low-level signal regardless of the output signal of the third flip-flop 221. The fourth flip-flop 223 latches and outputs a low-level signal, and the inverse of the error detection signal ERRDET, is then output at a high level. If a level of the output signal of the fourth flip-flop 223 is shifted to a low level, the sixth, seventh, and eighth AND gates 225, 226, and 227, which receive the output signal of the fourth flip-flop 223 and the carry signal C, output a low-level signal. If the carry signal C is continuously applied at a high level for four clocks of the gate clock signal GCLK, each of the sixth, seventh, and eighth AND gates 225, 226, and 227 outputs a low-level signal. Since the inverter 224 outputs a low-level signal, the flip-flops output a low-level signal in the order from the third flip-flop 221 to the first flip-flop 215. That is, if the carry signal C is applied at a high level for a first clock of the gate clock signal GCLK, the fourth flip-flop 223 outputs a low-level signal. If the carry signal C is maintained at a high level for a second clock of the gate clock signal GCLK, the third flip-flop 221 outputs the low-level signal as the third output signal OUT3. If the carry signal C is maintained at a high level for a third clock of the gate clock signal GCLK, the second flip-flop 218 outputs a low-level signal as the second output signal OUT2. If the carry signal C is maintained at a high level for a fourth clock of the gate clock signal GCLK, the first flip-flop 215 outputs the low-level signal as the first output signal OUT1. As such, if the first to fourth flip-flops 215, 218, 221, and 223 output the low-level signals, the vertical synchronization start signal SVsync is input again until the vertical synchronization start signal SVsync is input four times during one frame. In this case, the carry signal C is output from the timing controller 400 or the shift register unit 230 of the previous gate driver, and the output period of the carry signal C is determined according to the amount of data latched by the shift register unit 230 of the previous gate driver. That is, if the shift register unit 230 of the previous gate driver latches three data, the carry signal C is output for one clock, and if the shift register unit 230 of the previous gate driver latches two data, the carry signal C is output for two clocks. Further, if the shift register unit 230 of the previous gate driver latches one data, the carry signal C is output for three clocks, and if the shift register unit 230 of the previous gate driver latches the data, the carry signal C is output for four clocks.

Meanwhile, in the above-described embodiment, the error detecting unit includes the four flip-flops, and detects that the vertical synchronization start signal SVsync has been input as a high level for at least four times (4 GCLK pulses) during one frame. However, if the number of flip-flops is increased or decreased and the circuit structure controlling the input of the flip-flop is simplified or complicated, it is possible to control the acceptable number of clock pulses for which the input vertical synchronization start signal SVsync can be detected as high during one frame.

In the above-described embodiment, the carry signal C is input for four clocks of the gate clock signal GCLK to initiate the output of the flip-flop, and the vertical synchronization start signal SVsync is input again until four times during one frame. However, the carry signal C may be input during one clock, two clocks, or three clocks of the gate clock signal GCLK. In this case, it is possible to detect that the vertical synchronization start signal SVsync has been input as high once, two times, or three times during one frame.

According to the exemplary embodiment, each gate driver includes the shift register unit, the level shifter unit, and the output buffer unit. Each gate driver further includes the error detecting unit that detects an error in the vertical synchronization start signal input from the timing controller or the previous gate driver. The shift register unit is controlled according to the output signal of the error detecting unit, thereby controlling driving of the level shifter unit and the output buffer unit.

Accordingly, since it is possible to detect when an error occurs in the vertical synchronization start signal input from the timing controller due to a screen mode conversion, it is possible to prevent the driving voltage generator from being shut down due to an erroneous operation in the gate driver. Accordingly, an erroneous operation can be prevented in the display device.

Further, the error detecting unit includes the plurality of logical circuits that include the plurality of flip-flops, and each of the plurality of flip-flops shifts the previous data to the next flip-flop whenever the vertical synchronization start signal is input at a high level in synchronization with the gate clock signal. The number of flip-flops is controlled, thereby controlling the output of the error detection signal according to the acceptable number of clocks that the input vertical synchronization start signal may be high during one frame.

Although the control concepts have been described with reference to the accompanying drawings and an exemplary embodiment, the disclosure is not limited thereto. For example, in FIG. 3; instead of having an error detecting and correcting stage 210 positioned in front of each shift register unit 230, it is possible to have just one error detecting and correcting stage 210 positioned in front of the leftmost shift register unit 230 as shown. In view of this, it should be noted that various other changes and modifications can be made by those skilled in the art in light of the above without departing from the technical spirit of the appended claims.

What is claimed is:

1. A gate driver comprising:

an error detecting and blocking unit that measures during one frame a number of gate clock pulses supplied to the gate driver while an input vertical synchronization start signal is simultaneously at a logic high level during the one frame, where the error detecting and blocking unit outputs either a gated version of the vertical synchronization start signal or a logic low signal depending on how many gate clock pulses were measured in the one frame;

a shift register unit that receives an output signal of the error detecting and blocking unit and outputs a plurality of shifted signals;

a level shifter unit that shifts a level of at least one of the output signals of the shift register unit and outputs a corresponding level-shifted shift signal; and an output buffer unit that supplies an output signal of the level shifter unit to a gate line.

2. The gate driver of claim 1, wherein the error detecting and blocking unit outputs a gated version of the vertical synchronization start signal when the measured number of gate clock signals is smaller than a predetermined value, and outputs a logic low-level signal when the measured number is equal to or larger than the predetermined value.

3. The gate driver of claim 1, wherein the shift register unit shifts a level of the output signal of the error detecting and blocking unit in response to the gate clock signal.

4. The gate driver of claim 1, wherein the error detecting and blocking unit includes:

a plurality of flip-flops that shift a level of the input vertical synchronization start signal whenever the input vertical synchronization start signal is input in synchronization with the gate clock signal.

5. The gate driver of claim 4, wherein the plurality of flip-flops operate in response to a transition between at least two logic levels of the input vertical synchronization start signal, and in response to the gate clock signal, and a supplied carry signal.

6. The gate driver of claim 5 wherein:

a first of the first flip-flops latches levels of at least two logic levels of the input vertical synchronization start signal, and in response the supplied carry signal, and a second of the flip-flops latches levels of at least two logic levels, an output signal of the first flip-flop, and an output signal of another of the flip-flops.

7. The gate driver of claim 6, wherein the carry signal is output from a previous gate driver according to a number of data latched by a shift register unit of the previous gate driver.

8. The gate driver of claim 5, wherein the error detecting and blocking unit further includes:

a first logical unit that receives the carry signal and the gate clock signal;

a second logical unit that receives the gate clock signal and the vertical synchronization start signal; and a third logical unit that receives output signals of the first and second logical units, and the plurality of flip-flops are driven according to an output signal of the third logical unit.

9. The gate driver of claim 5, wherein the error detecting and blocking unit further includes:

a fourth logical unit that receives the carry signal and the output signal of the next flip-flop; and a fifth logical unit that receives an output signal of the fourth logical unit and the vertical synchronization start signal, and the first flip-flop latches a level of an output signal of the fifth logical unit.

10. The gate driver of claim 5, wherein the error detecting and blocking unit further includes:

a sixth logical unit that receives an inversion signal of the carry signal and the output signal of the previous flip-flop;

a seventh logical unit that receives the carry signal and the output signal of the next flip-flop; and an eighth logical unit that receives output signals of the sixth and seventh logical units, and the final flip-flop latches a level of an output signal of the next logical unit.

11. The gate driver of claim 1, wherein the error detecting and blocking unit has final flip-flop and the gate driver further comprises:

an inverter that inverts an output signal of a final flip-flop; and a logical unit that receives an output signal of the inverter and the input vertical synchronization start signal, and outputs a gated version of the vertical synchronization start signal to the shift register unit.

12. A method of driving a gate driver in a display system designed to have a predetermined number of gate clock signal pulses during one frame and a predetermined duration of activation of a vertical synchronization start signal during the one frame, the method comprising:

measuring the number of gate clock signals received by the gate driver in an interval where the vertical synchronization start signal supplied to gate driver is at an activation indicating, high level and in response to the measured number, either outputting a copy of the vertical synchronization start signal or a low-level signal;

outputting a plurality of shift signals according to the copy of the vertical synchronization start signal and in response to the gate clock signal;

shifting levels of the shift signals in response to the shift signals and outputting the level-shifted shift signals; and supplying the shift signals to gate lines.

13. A display device comprising:

a display panel that displays an image;

a timing controller that processes an externally input image signal and generates a plurality of control signals;

a driving voltage generator that generates a plurality of driving voltages including a gate driving voltage and a data driving voltage;

gate drivers each of which receives gate clock signals and which measures the number of gate clock signals in an interval where a received vertical synchronization start signal is at an activation indicating, high level during one frame, and in response to the measured number, selectively outputs either a copy of the vertical synchronization start signal or a low-level signal, and applies the gate driving voltage to gate lines in response to the selectively output copy of the vertical synchronization start signal; and a data driver that generates a data signal using the data driving voltage and applies the data signal to data lines.

14. The display device of claim 13, wherein each of the gate drivers includes:

an error detecting unit that measures the number of gate clock signals in an interval where the vertical synchronization start signal is at a high level during one frame and outputs the vertical synchronization start signal or the low-level signal;

a shift register unit that receives an output signal of the error detecting unit and outputs shift signals;

a level shifter unit that shifts levels of the shift signals in response to the shift signals and outputs the level-shifted shift signals; and an output buffer unit that supplies an output signal of the level shifter unit to gate lines.

15. The display device of claim 14, wherein the level shifter unit has a plurality of level shifters, and the error detecting unit detects the vertical synchronization start signal that is input such that excessive number of the level shifters of the level shifter unit simultaneously operate during one frame to cause the driving voltage generator to abnormally operate.

16. The display device of claim 14, wherein the error detecting unit includes:

a plurality of flip-flops that shift a level of the vertical synchronization start signal whenever the vertical synchronization start signal is input in synchronization with the gate clock signal.

17. The display device of claim 16, wherein the error detecting unit further includes:

an inverter that inverts an output signal of the final flip-flop; and a logical unit that receives an output signal of the inverter and the vertical synchronization start signal and outputs the received signals to the shift register unit.

18. The display device of claim 12, wherein the first gate driver receives the vertical synchronization start signal from the timing controller and a next gate driver receives the vertical synchronization start signal from the previous gate driver.

19. A method of preventing multiple assertions of an input vertical synchronization start signal during one frame from being passed along through a plurality of shift register units that respectively control application of gate line actuating voltages to respective gate lines of a flat panel display unit, the method comprising:

during each frame, detecting the number of gate clock periods for which the input vertical synchronization start signal is asserted as a logic high; and in response to said detecting, blocking a currently input vertical synchronization start signal from being passed along through the plurality of shift register units during the frame if the detected number of gate clock periods in the frame equals or exceeds a predefined number.

20. The method of claim 19 wherein said detecting of the number of gate clock periods includes resetting a plurality of flip-flops at the start of each frame and advancing a first detected assertion of the input vertical synchronization start signal as a logic high from one of the plural flip-flops to the next for each gate clock period in the frame where the input vertical synchronization start signal is further asserted as a logic high.

* * * * *